US007311070B2

(12) United States Patent
Yamada

(10) Patent No.: US 7,311,070 B2
(45) Date of Patent: Dec. 25, 2007

(54) VARIABLE VALVE SYSTEM OF INTERNAL COMBUSTION ENGINE AND METHOD OF ASSEMBLING SAME

(75) Inventor: Yoshihiko Yamada, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 31 days.

(21) Appl. No.: 11/151,235

(22) Filed: Jun. 14, 2005

(65) Prior Publication Data

US 2005/0279304 A1 Dec. 22, 2005

(30) Foreign Application Priority Data

Jun. 16, 2004 (JP) ..... 2004-177783

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15; 70/40, 44
See application file for complete search history.

(56) References Cited

U.S. PATENT DOCUMENTS 6,615,777 B2 9/2003 Grau
2004/0083997 A1* 5/2004 Shibata et al. ..... 123/90.16

* cited by examiner

*Primary Examiner*—Zelalem Eshete
(74) *Attorney, Agent, or Firm*—Foley & Lardner LLP

(57) ABSTRACT

A variable valve system of an internal combustion engine varies an operation manner of an engine valve by controlling an angular position of a control shaft. The system comprises a stopper mechanism that determines an angular range in which the control shaft is permitted to rotate about its axis; an actuating mechanism that actuates the control shaft to rotate about its axis; and a position matching device that is practically assembly only when the actuating mechanism is being assembled. The position matching device, when assembled, restricts operation of the actuating mechanism in such a manner as to match a maximally operated position of the actuating mechanism with a maximally operated angular position of the control shaft.

18 Claims, 13 Drawing Sheets

VARIABLE VALVE SYSTEM OF INTERNAL COMBUSTION ENGINE AND METHOD OF ASSEMBLING SAME

BACKGROUND OF THE INVENTION

1. Field of the Invention

The present invention relates in general to a variable valve system of an internal combustion engine, which is able to vary a lift degree (or work angle) of engine valves (viz., intake and/or exhaust valves) in accordance with an operation condition of the engine. More specifically, the present invention relates to such variable valve system and a method of assembling the same.

2. Description of the Related Art

Hitherto, in the field of variable valve systems of an internal combustion engine, various types have been proposed and put into practical use. One of the systems is shown in U.S. Pat. No. 6,615,777.

The variable valve system of this US patent generally comprises a valve lift varying mechanism that, by rotating a control shaft, varies a lift degree (or work angle) of engine valves (viz., intake and/or exhaust valves) and an actuating mechanism that drives or rotates the control shaft in accordance with an operation condition of the engine.

The actuating mechanism comprises an electric motor, an output shaft driven by the electric motor, a screw nut having an inner thread meshed with an outer thread formed on the output shaft, a link member having a forked end pivotally connected to diametrically opposed portions of the screw nut through bearing pins and a lever member having one end pivotally connected to the other end of the link member and the other end rotatably connected to the control shaft through a pin. The control shaft has adjusting cams integrally connected thereto.

When, upon energization of the electric motor, the output shaft is rotated about its axis, the screw nut is moved axially forward or rearward along the output shaft pivotally moving both the link member and the lever member. With this, the control shaft is turned about its axis to a desired angular position.

SUMMARY OF THE INVENTION

However, due to its inherent construction, the actuating mechanism disclosed by the above-mentioned US patent fails to show an exact position control of the screw nut relative to the output shaft. More specifically, because of the nature of the meshed engagement between the screw nut and the output shaft, the maximally moved position of the screw nut relative to the output shaft is not exactly defined or controlled, which tends to induce a poor positioning of the control shaft at the maximally turned angular position. Of course, such poor positioning of the control shaft has an undesired influence on the controllability of the variable valve system.

It is therefore an object of the present invention to provide a variable valve system of an internal combustion engine, which is free of the above-mentioned drawback.

That is, an object of the present invention is provide a variable valve system of an internal combustion engine, which can exhibit a satisfied controllability of the system throughout all ranges of the angular position of the control shaft.

In accordance with a first aspect of the present invention, there is provided a variable valve system of an internal combustion engine for varying an operation manner of an engine valve by controlling an angular position of a control shaft, which comprises a stopper mechanism that determines an angular range in which the control shaft is permitted to rotate about its axis; an actuating mechanism that actuates the control shaft to rotate about its axis; and a position matching device that is practically assembled only when the actuating mechanism is being assembled, the position matching device when assembled restricting operation of the actuating mechanism in such a manner as to match a maximally operated position of the actuating mechanism with a maximally operated angular position of the control shaft.

In accordance with a second aspect of the present invention, there is provided a variable valve system of an internal combustion engine for varying an operation manner of an engine valve by controlling an angular position of a control shaft. The variable valve system comprises a stopper mechanism that determines an angular range in which the control shaft is permitted to rotate about its axis; and an actuating mechanism that actuates the control shaft to rotate about its axis, the actuating mechanism comprising an externally threaded shaft that is turned about its axis in accordance with the operation condition of the engine; an internally threaded nut member operatively engaged with the threaded shaft so that turning of the threaded shaft induces an axial movement of the nut member along the threaded shaft, the nut member being contactable with the position matching device when the latter is assembled; a transmission mechanism provided between the control shaft and the nut member to convert the axial movement of the nut member to a rotary motion of the control shaft; a housing that houses therein the threaded shaft, the threaded nut member and the transmission mechanism; and a position matching device that is practically assembled only when the actuating mechanism is being assembled, the position matching device when assembled restricting operation of the actuating mechanism in such a manner as to match a maximally operated position of the actuating mechanism with a maximally operated angular position of the control shaft.

In accordance with a third aspect of the present invention, there is provided a method of assembling a variable valve system of an internal combustion engine, the variable valve system varying an operation manner of an engine valve by controlling an angular position of a control shaft and comprising a stopper mechanism that determines an angular range in which the control shaft is permitted to rotate and an actuating mechanism that actuates the control shaft to rotate about its axis. The method comprises placing a positioning bolt at a given position of a way along which an element of the actuating mechanism moves, the given position being a position where the element contacts the positioning bolt when the stopper mechanism causes the control shaft to take a maximally operated position; causing the element of the actuating mechanism to contact with the positioning bolt; connecting the actuating mechanism and the control shaft; removing the positioning bolt from the given position; placing a close bolt to the given position in place of the positioning bolt.

Other objects and advantages of the present invention will become apparent from the following description when taken in conjunction with the accompanying drawings.

BRIEF DESCRIPTION OF THE DRAWINGS

FIGS. 9A and 9B are views taken from the direction of the arrow "A" of FIG. 8, in which FIG. 9A shows a valve closing operation under the lowest lift of the intake valves, and FIG. 9B shows a valve opening operation under the lowest lift of the intake valves;

FIGS. 10A and 10B are views similar to FIGS. 9A and 9B, but in which FIG. 10A shows a valve closing operation under the highest lift of the intake valves, and FIG. 10B shows a valve opening operation under the highest lift of the intake valves;

DETAILED DESCRIPTION OF THE INVENTION

In the following, the present invention will be described in detail with reference to the accompanying drawings.

For ease of understanding, various directional terms, such as, right, left, upper, lower, rightward and the like are used in the following description. However, such terms are to be understood with respect to only a drawing or drawings on which corresponding part or portion is shown.

Before describing the detail of the invention, an outlined construction of a variable valve system 100 of the invention will be described with reference to FIGS. 8, 9A, 9B, 10A and 10B.

Figure 8:
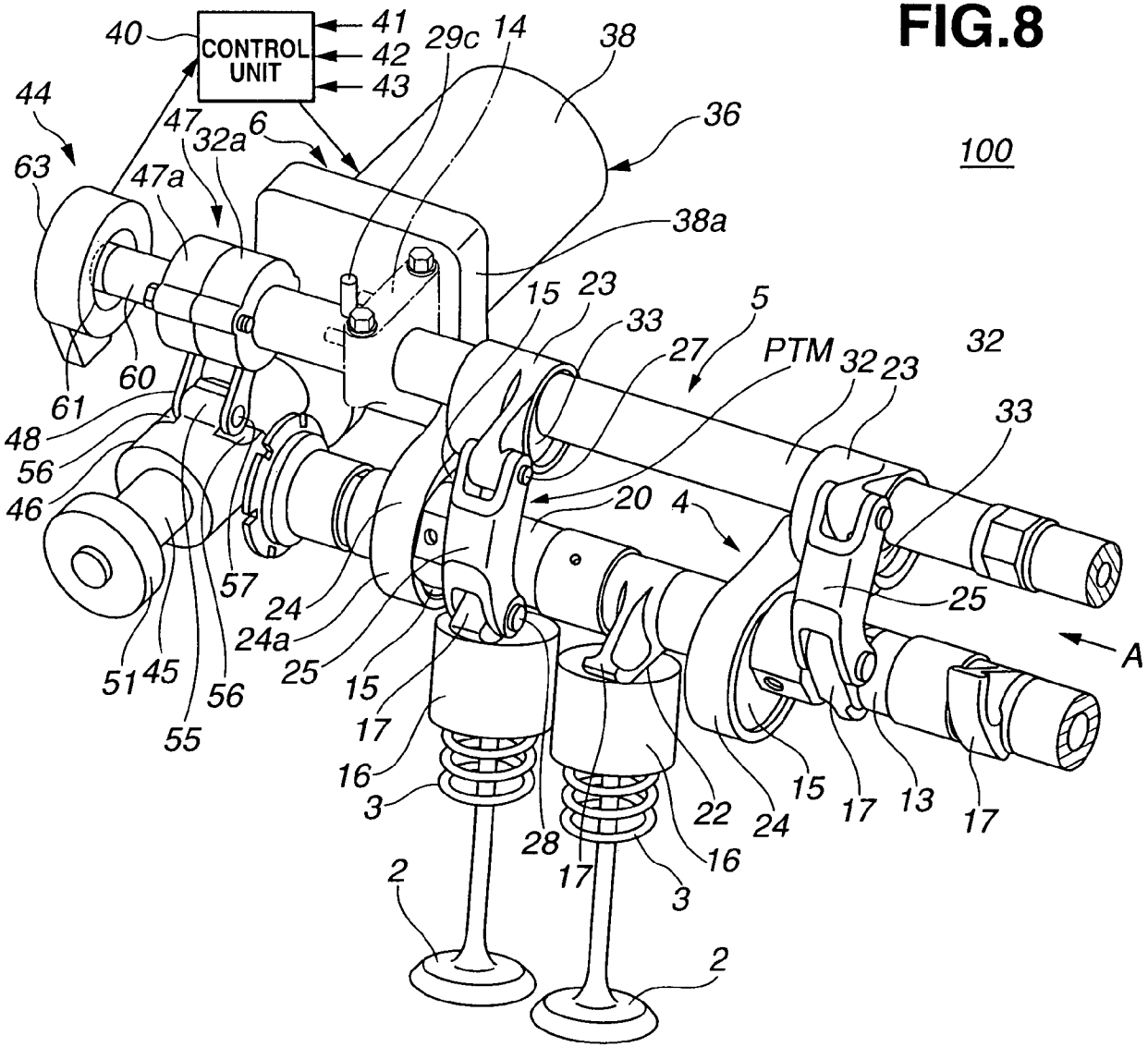
FIG. 8 is a perspective view of the variable valve system of the present invention.

As will be understood from FIG. 8, variable valve system 100 shown in the drawing is designed for multi-cylinder internal combustion engines of a type that has two intake valves 2 and 2 for each cylinder.

That is, variable valve system 100 is constructed to control operation of paired intake valves 2 and 2 (viz., engine valves) for each cylinder of the engine. Intake valves 2 and 2 are slidably guided by a cylinder head 1 (see FIG. 9A) through valve guides (not shown). Each intake valve 2 has a valve spring 3 for being biased in a closing direction, and has a valve lifter 16 mounted on a stem thereof.

As will be described in detail hereinafter, variable valve system 100 generally comprises a valve lift mechanism 4 that induces an open/close condition of intake valves 2 and 2, a valve lift degree varying mechanism 5 that is incorporated with valve lift mechanism 4 to vary a lift degree (or work angle) of intake valves 2 and 2 and an actuating mechanism 6 that actuates the valve lift degree varying mechanism 5 (more specifically, a control shaft 32 of this mechanism 5) in accordance with an operation condition of the engine.

It is to be noted that the work angle of engine valve 2 is an event corresponding to a period or span in terms of crank angle, that elapses from a time when the valve 2 is just opened to a time when the valve 2 is just closed in each operation cycle of the engine.

As is seen from FIG. 8, valve lift mechanism 4 comprises a hollow drive shaft 13 that is rotatably held on an upper portion of cylinder head 1 through bearings 14 (see FIG. 9A), a drive cam 15 for each cylinder, that is fixed, through a press-fitting or the like, to hollow drive shaft 13 to rotate therewith, two swing cams 17 and 17 for each cylinder, that are integrally mounted on a cylindrical camshaft 20 rotatably disposed on hollow drive shaft 13 and operatively contact with valve lifters 16 and 16 of intake valves 2 and 2 to induce an open/close operation of intake valves 2 and 2 and a power transmitting mechanism "PTM" that is arranged between drive cam 15 and each of swing cams 17 and 17 to transmit a torque of drive cam 15 to swing cams 17 and 17. Actually, due to an after-mentioned linkage construction of power transmitting mechanism "PTM", the rotary motion of drive cam 15 is converted to a swing motion of swing cams 17 and 17.

Hollow drive shaft 13 extends along an axis of the engine. Although not shown in the drawings, hollow drive shaft 13 has one end to which a torque is applied from a crankshaft of the engine through a sprocket fixed to the end of drive shaft 13 and a timing chain that is put around the sprocket and the crankshaft. That is, drive shaft 13 is driven or rotated by the crankshaft of the engine. Usually, an operation phase varying mechanism (not shown) is arranged between the crankshaft and drive shaft 13 for varying or controlling an operation phase of drive shaft 13 relative to the crankshaft of the engine.

Figure 9A:
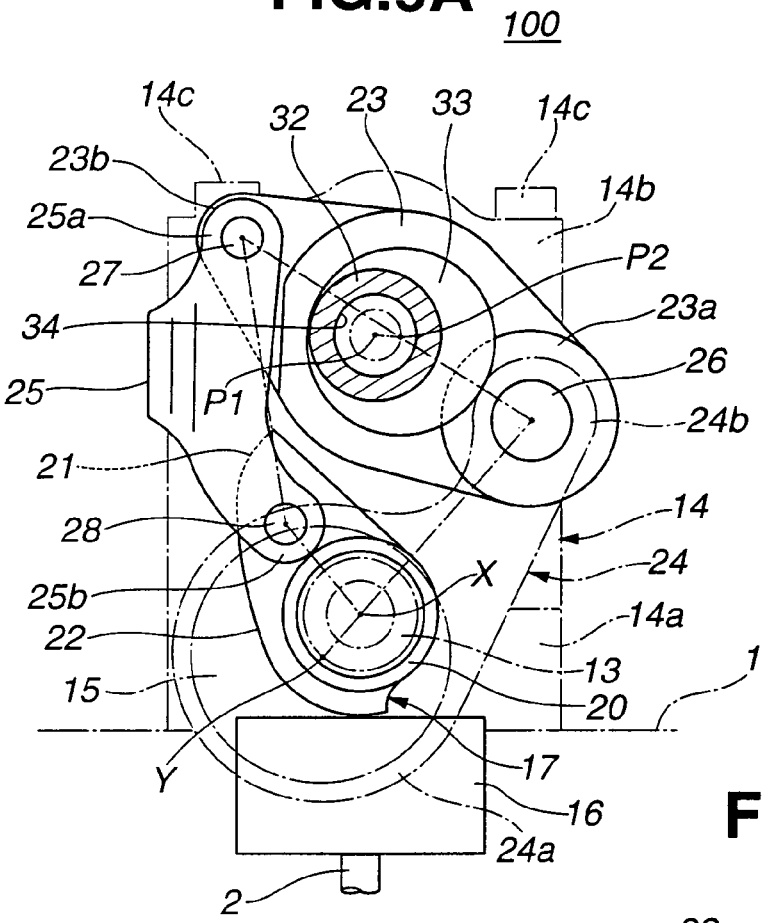

As is seen from FIG. 9A, each of bearings 14 comprises a main bracket 14*a* that is mounted on cylinder head 1 to rotatably support drive shaft 13, a sub-bracket 14*b* that is mounted on main bracket 14*a* to rotatably support an after-mentioned control shaft 32 and a pair of connecting bolts 14*c* and 14*c* that pass through both sub-bracket 14*b* and main bracket 14*a* to tightly connect these brackets 14*b* and 14*a* to cylinder head 1.

Drive cam 15 is a circular disc that has a center axis "Y" displaced or eccentric from a center axis "X" of drive shaft 13. More specifically, the circular disc 15 has at an eccentric portion thereof a circular opening through which drive shaft 13 passes. For the integral rotation of drive cam 15 with drive shaft 13, drive shaft 13 is secured to the circular opening of the drive cam 15 through press-fitting or the like.

The two swing cams 17 and 17 are substantially the same in construction and have a generally triangular cross section. These two swing cams 17 and 17 are integrally mounted on axially opposed end portions of cylindrical camshaft 20 that is swingably disposed about hollow drive shaft 13.

As shown in FIG. 9A, each swing cam 17 has a cam nose portion 21 and a cam surface 22 at its lower side.

As is seen from this drawing, cam surface 22 of each swing cam 17 includes a base round part that extends around the cylindrical outer surface of camshaft 20, a lump part that extends from the base round part toward cam nose portion 21 and a lift part that extends from the lump part to a maximum lift point defined at the leading end of cam nose portion 21. That is, under operation, these parts of cam surface 22 slidably contact an upper surface of the corresponding valve lifter 16 thereby to induce the open/close operation of the corresponding intake valve 2 in accordance with a swing movement of swing arms 17 and 17.

As is understood from FIG. 8, power transmitting mechanism "PTM" comprises a rocker arm 23 that is pivotally disposed about control shaft 32 positioned above drive shaft 13, a link arm 24 that pivotally connects one wing part 23*a* (see FIG. 9A) of rocker arm 23 to drive cam 15, and a link rod 25 that pivotally connects the other wing part 23*b* of rocker arm 23 to one of swing cams 17 and 17.

As is seen from FIGS. 8 and 9A, rocker arm 23 has at its middle part a cylindrical bore (no numeral) in which an after-mentioned control cam 33 is rotatably disposed.

As shown in FIG. 9A, wing part 23*b* of rocker arm 23 is pivotally connected to one end of link rod 25 through a pivot pin 27. The other wing part 23*a* of rocker arm 23 is pivotally connected to a radially projected arm portion 24*b* of link arm 24 through a pivot pin 26.

The two wing parts 23*a* and 23*b* of rocker arm 23 extend radially outward from axially opposed end portions of the bored middle part of rocker arm 23.

As is understood from FIG. 9A, link arm 24 comprises an annular base portion 24*a* that rotatably receives therein the above-mentioned drive cam 15 and the above-mentioned radially projected arm portion 24*b* that is pivotally connected to wing part 23*a* of rocker arm 23 through pivot pin 26.

As is best seen from FIGS. 8 and 9A, link rod 25 is a curved channel member that has an upper end 25*a* pivotally connected to wing part 23*b* of rocker arm 23 through pivot pin 27 and a lower end 25*b* pivotally connected to swing cam 17 through a pivot pin 28.

Although not shown in the drawings, pivot pins 26, 27 and 28 are equipped at one ends with respective snap rings for holding link arm 24 and link rod 25 at their properly set positions.

In the following, valve lift degree varying mechanism 5 will be described in detail with reference to the drawings.

As is seen from FIG. 8, valve lift degree varying mechanism 5 comprises control shaft 32 that extends in parallel with the above-mentioned drive shaft 13 and is rotatably held by bearings 14 (see FIG. 9A), and a control cam 33 for each cylinder, which is secured to control shaft 32 to rotate therewith. As has been mentioned hereinabove, control cam 33 is rotatably disposed in the cylindrical bore provided in the middle part of rocker arm 23. That is, control cam 33 serves as a swinging fulcrum of rocker arm 23.

As is described hereinabove and seen from FIGS. 1, 2 and 9A, control shaft 32 is rotatably held between main-bracket 14*a* and sub-bracket 14*b* of each bearing 14 that is tightly mounted on cylinder head 1.

Figure 1:
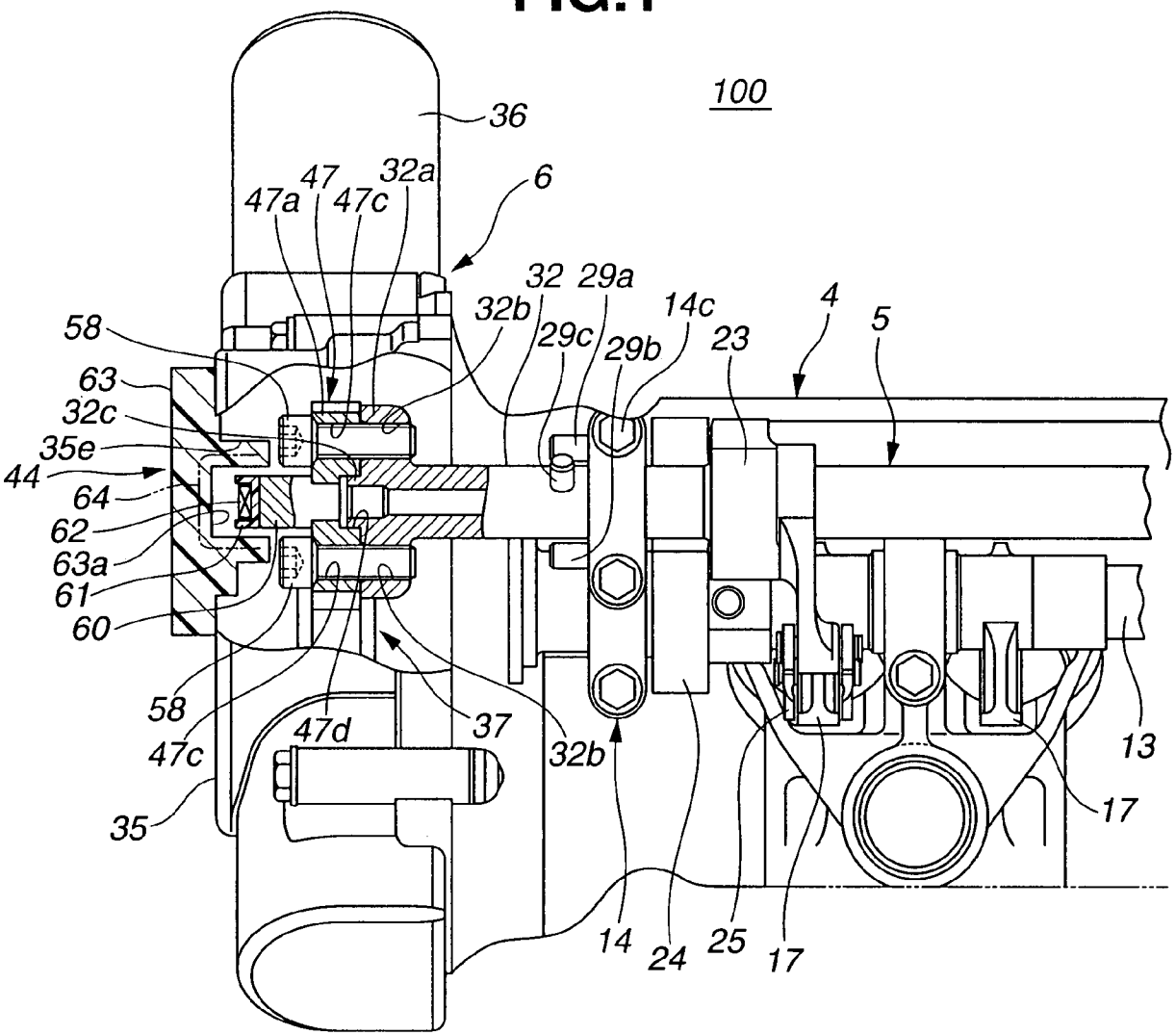
FIG. 1 is a partially sectional plan view of a variable valve system of the present invention.
Figure 3:
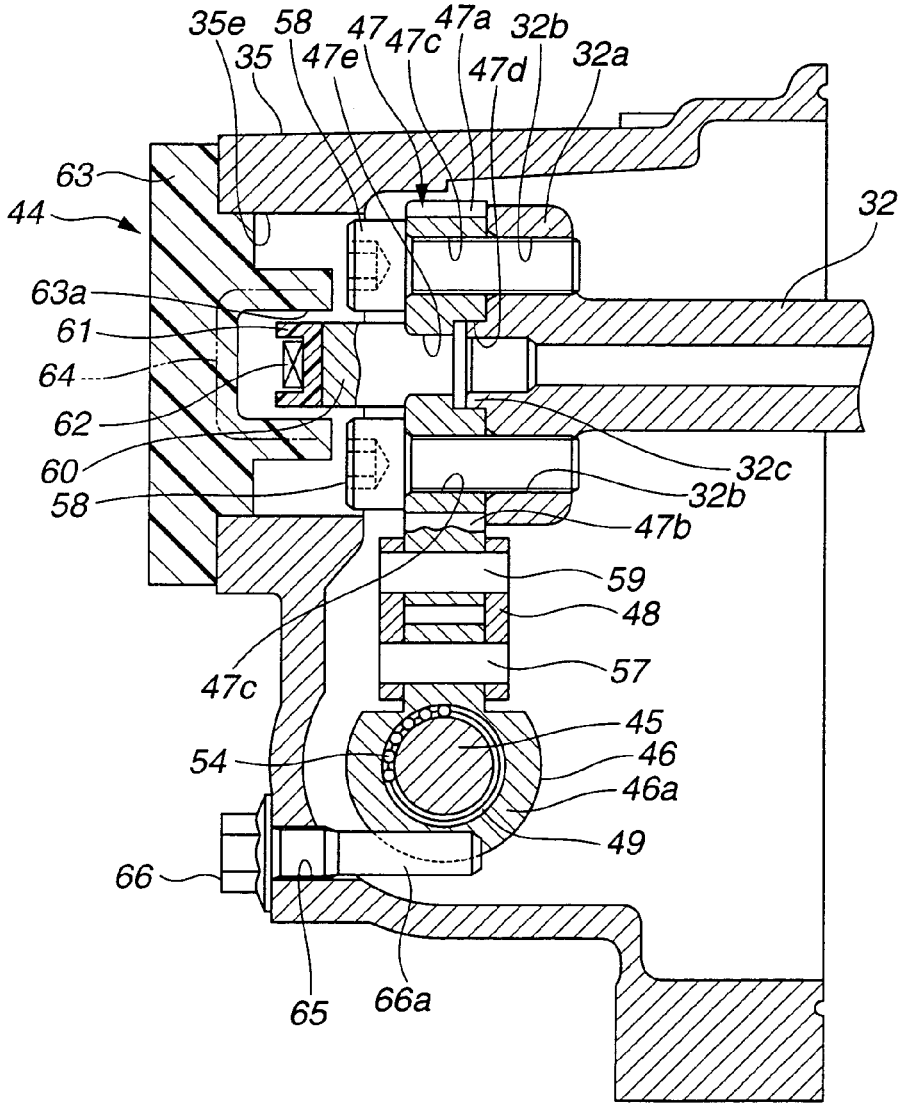
FIG. 3 is a sectional view of an essential portion of the variable valve system of the invention, showing a connection between a control shaft and an actuating mechanism.

As is seen from FIGS. 1 and 3, control shaft 32 is integrally formed, at an end portion thereof near actuating mechanism 6, with a trapezoidal flange 32*a* that has at radially projected two portions respective threaded bores 32*b*. It is however to be noted that these bores 32*b* are not positioned at diametrically opposite portions of control shaft 32. That is, the bores 32*b* are provided at asymmetric positions with respect to an axis of control shaft 32.

As is best seen from FIG. 3, at a left end of control shaft 32, there is integrally formed an annular projection 32*c* that projects leftward from a center portion of the trapezoidal flange 32*a*.

Figure 2:
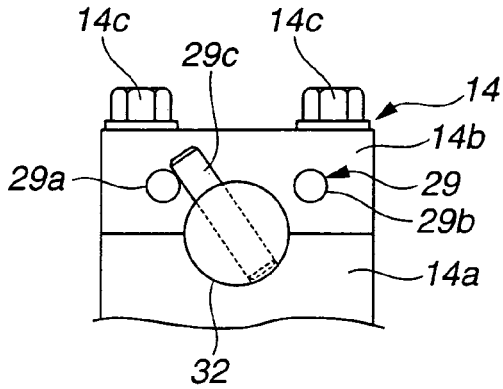
FIG. 2 is a front view of a stopper mechanism employed in the variable valve system of the present invention.

As is seen from FIGS. 1 and 2, for controlling or restricting a rotation range of control shaft 32, there is provided a stopper mechanism 29.

Stopper mechanism 29 comprises first and second stopper pins 29*a* and 29*b* that are projected from sub-bracket 14*b* of bearing 14, and a stopper arm 29*c* that is fixed to control shaft 32. As is seen from these drawings, upon rotation of control shaft 32, stopper arm 29*c* is brought into contact with first or second stopper pin 29*a* or 29*b* thereby to restrict the rotation range of control shaft 32.

As is seen from FIG. 9A, control cam 33 is a circular disc that has a center axis "P2" displaced or eccentric from a center axis "P1" of control shaft 32. More specifically, the circular disc 33 has at an eccentric portion thereof a circular opening through which control shaft 32 passes. For the integral rotation of control cam 33 with control shaft 32, control shaft 32 is secured to the circular opening of control cam 33 through press-fitting or the like.

In the following, actuating mechanism 6 will be described with reference to FIGS. 1 to 5 and 8. It is to be noted that actuating mechanism 6 shown in FIG. 8 has some parts removed for clarifying the arrangement of essential elements of the mechanism 6.

As is seen from FIG. 1, actuating mechanism 6 generally comprises a cylindrical housing 35 that is mounted on one end of cylinder head 1 in a manner to extend perpendicular to control shaft 32 and thus perpendicular to drive shaft 13, an electric motor 36 that is connected to one axial end of cylindrical housing 35, and a ball-screw type transmission mechanism 37 that is installed in cylindrical housing 35 for transmitting a torque of electric motor 36 to control shaft 36 while reducing the rotation speed.

Figure 4:
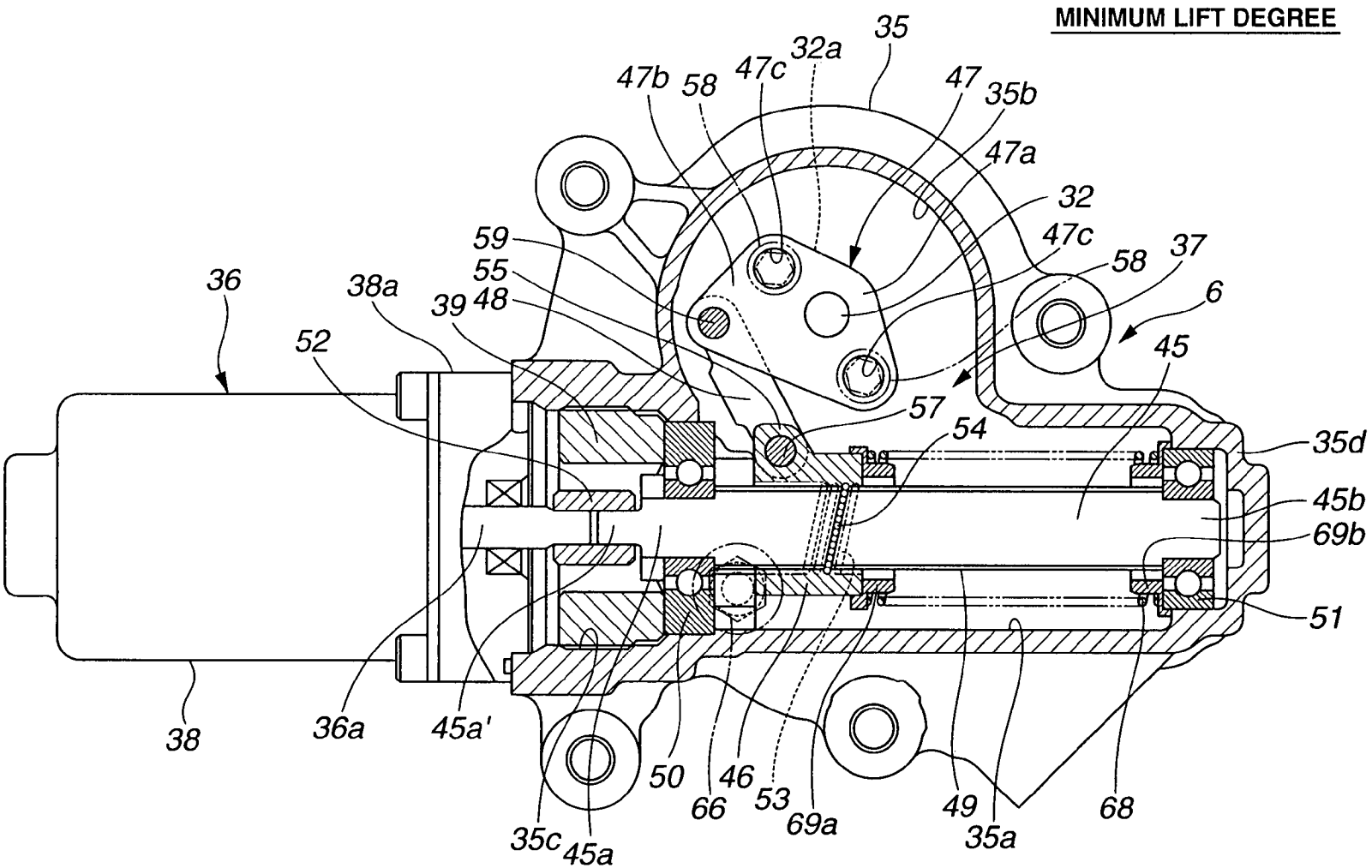
FIG. 4 is a sectional view of the actuating mechanism in a condition to induce the minimum lift of engine valves.
Figure 5:
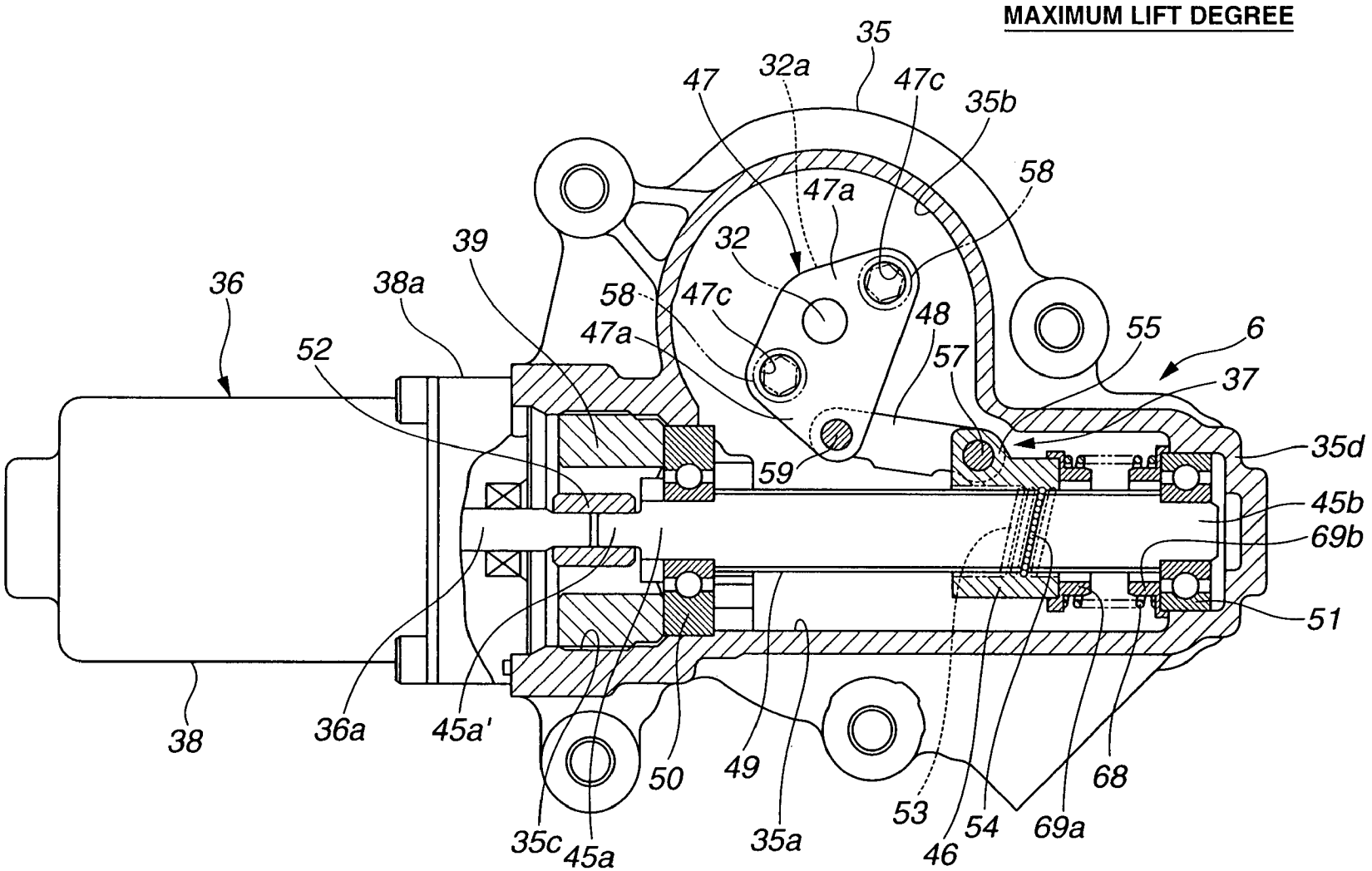
FIG. 5 is a view similar to FIG. 4, but showing a condition to induce the maximum lift of intake valves of the engine.

As is seen from FIGS. 4 and 5, cylindrical housing 35 is constructed of an aluminum alloy or the like and includes generally an elongate lower bore 35*a* that extends axially along the housing 35 and an upper bore 35*b* that extends upward from a middle portion of elongate lower bore 35*a*. That is, these two bores 35*a* and 35*b* are merged to constitute a so-called part housing room. As shown, in elongate lower bore 35*a*, there is arranged the above-mentioned ball-screw type transmission mechanism 37, and into upper bore 35*b*, there is projected trapezoidal flange 32*a* of control shaft 32.

Although not shown in FIG. 1, the two bores 35*a* and 35*b* have respective openings that are covered by respective covers through sealing members. As shown in FIG. 4, elongate lower bore 35*a* has a left end 35*c* opened and a right end closed by a wall 35*d*.

As is seen from FIGS. 4 and 8, electric motor 36 is of a DC type which comprises a cylindrical casing 38 that has an opened base end 38*a* tightly connected to the opened end 35*c* (see FIG. 4) of elongate lower bore 35*a*. Electric motor 36 has an output shaft 36*a* rotatably held by a retainer 39 tightly received in the opened left end 35*c* (see FIG. 4). For sealing output shaft 36*a*, there is provided a mechanical seal between retainer 39 and output shaft 36*a*.

As is seen from FIG. 8, electric motor 36 is controlled by a control unit 40. That is, control unit 40 outputs an instruction signal to electric motor 36 by processing various information signals fed thereto. These information signals are, for example, signals from a crank angle sensor 41, an air flow meter 42, an engine cooling water temperature sensor 43 and a rotation angle sensor 44 for control shaft 32. By processing these information signals, control unit 40 derives a current operation condition of the engine and outputs an instruction signal to electric motor 36 in accordance with the derived operation condition of the engine.

Referring back to FIG. 4, ball-screw type transmission mechanism 37 generally comprises a ball-screw shaft 45 that extends axially in elongate lower bore 35*a* to be coaxially connected to output shaft 36*a* of electric motor 36, a ball-nut 46 that is disposed about ball-screw shaft 45 to operatively engage with the same, a lever member 47 that is secured to the above-mentioned trapezoidal flange 32*a* of control shaft 32 by means of connecting bolts 58, and a channel shaped link member 48 that pivotally connects lever member 47 and ball-nut 46. Lever member 47 and link member 48 thus constitute a transmission mechanism.

Ball-screw shaft 45 is formed with a threaded outer surface 49 except axially opposite end portions 45*a* and 45*b* thereof. As shown in FIG. 4, opposite end portions 45*a* and 45*b* of ball-screw shaft 45 are rotatably held by left and right ball bearings 50 and 51 which are tightly held in elongate lower bore 35*a*.

Left end portion 45*a* of ball-screw shaft 45 has a hexagonal head 45*a*' that is axially movably received in a hexagonal socket 52 that is fixed to a leading end of output shaft 36*a* of electric motor 36. Thus, output shaft 36*a* and ball-screw shaft 45 can rotate together like a single unit while being permitted to move axially relative to each other.

As is seen from FIGS. 4, 5 and 8, ball-nut 46 is meshed with ball-screw shaft 45 so that rotation of ball-screw shaft 45 about its axis induces a forward or rearward movement of ball-nut 46 along ball-screw shaft 45. That is, ball-nut 46 is a cylindrical member that has a bore whose inner surface is formed with a spiral thread 53 that is meshed with a spiral thread 49 formed on the outer surface of ball-screw shaft 45.

A plurality of fine balls 54 are operatively received in spiral thread 53 of ball-nut 46 for achieving a smoothed movement of ball-nut 46 along ball-screw shaft 45. Two deflectors (no numerals) are provided by spiral thread 53 of ball-nut 46 to produce an endless screw passage of the threads in and along which fine balls 54 run endlessly under movement of ball-nut 46 along ball-screw shaft 45.

Thus, in operation, rotation of ball-screw shaft 45 about its axis is converted to the axial movement of ball-nut 46 through fine balls 54.

As is seen from FIG. 4, ball-nut 46 is formed with a round projection 55 to which lower ends of the above-mentioned link member 48 are pivotally connected through a pivot pin 57. As shown in FIG. 8, at axially opposite sides of round projection 55, there are provided curved cuts 56 for permitting a swing movement of rounded lower ends of the channel-shaped link member 48.

For achieving a proper positioning of ball-nut 46 at the time when transmission mechanism 37 is being assembled in housing 35, there is provided a position matching device.

That is, by using this position matching device, the leftmost position of ball-nut 46 in FIG. 4 relative to ball-screw shaft 45 is assured. In other words, the most-clockwise position of control shaft 32 in the same drawing, that induces a minimum lift degree of intake valves 2, is assured.

Figure 6:
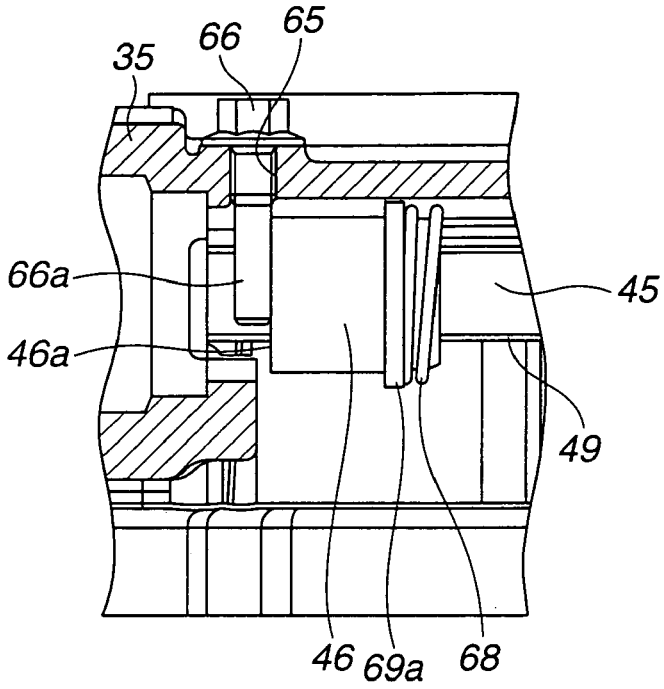
FIG. 6 is a sectional view of a portion of the variable valve system where a positioning bolt is operatively engaged with a positioning opening.

That is, as is seen from FIGS. 3, 4 and 6, the position matching device comprises a threaded positioning opening 65 provided in a wall of housing 35 and an elongate positioning bolt 66 detachably fixed to positioning opening 65. As is seen from FIG. 4, positioning bolt 66 is positioned just before left ball bearing 50.

As is seen from FIG. 6, when positioning bolt 66 is properly fixed to positioning opening 65, a rod portion 66*a* of positioning bolt 66 serves as a stopper for stopping excessive axial movement of ball-nut 46. That is, in such case, left end surface 46*a* of ball-nut 46 is brought into abutment with rod portion 66*a* of positioning bolt 66, as shown.

It is now to be noted that the position of ball-nut 46 determined by positioning bolt 66 corresponds to an angular position of control shaft 32 determined by the above-mentioned stopper mechanism 29 (see FIG. 1). That is, in such case, stopper arm 29*c* of control shaft 32 is in abutment with first stopper pin 29*a*, and as will be described in detail hereinafter, intake valves 2 of the engine are subjected to a minimum lift operation.

Figure 7:
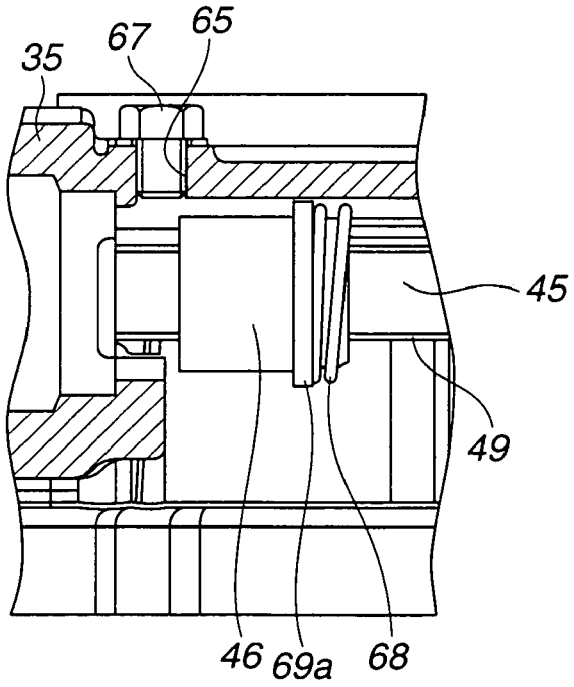
FIG. 7 is a view similar to FIG. 6, but showing a condition wherein a close bolt is engaged with the positioning opening in place of the positioning bolt.

When the assembling work of transmission mechanism 37 is finished, positioning bolt 66 is removed and in place of it, a close bolt 67 is fitted to positioning opening 65, as is seen from FIG. 7.

As is seen from FIG. 4, between ball-nut 46 and right ball bearing 51, there is compressed through respective retainers 69*a* and 69*b* a coil spring 68 that is disposed about ball-screw shaft 45. Thus, coil spring 68 functions to bias ball-nut 46 in such a direction as to induce the minimum lift operation of intake valves 2.

As is seen from FIG. 4, lever member 47 is trapezoidal in shape and comprises a base portion 47*a* that is secured to trapezoidal flange 32*a* of control shaft 32 by means of two bolts 58 and a radially projected portion 47*b* that extends radially outward from base portion 47*a*.

As is seen from FIG. 3, the two bolts 58 are engaged with the above-mentioned asymmetrically arranged threaded bores 32*b* of the flange 32*a* of control shaft 32. For receiving bolts 58, base portion 47*a* of lever member 47 are formed with two arcuate openings 47*c*. Although not well shown in the drawings, each arcuate opening 47*c* is shaped to extend around the axis of control shaft 32.

As is seen from FIGS. 1 and 3, lever member 47 is formed at its back surface with an annular recess 47*d* into which the above-mentioned annular projection 32*c* of control shaft 32 is snugly received.

As is seen from FIG. 4, radially projected portion 47*b* of lever member 47 is formed with an opening (no numeral) through which an after-mentioned pin 59 passes for pivotally connecting the link member 48 to the radially projected portion 47*b*.

Link member 48 having a generally U-shaped cross section is produced by pressing a flat metal plate. That is, link member 48 comprises two parallel wall portions and a bridge portion that extends between the two parallel wall portions.

As is seen from FIGS. 1 and 3, particularly FIG. 3, the above-mentioned rotation angle sensor 44 is arranged to face the lever member 47.

Rotation angle sensor 44 comprises a cylindrical metal member 60 that is coaxially connected to the leading end of control shaft 32 passing through an opening 47*e* of lever member 47. A round plastic holder 61 is secured to the leading end of cylindrical metal member 60. For this fixing, an integral molding technique is used. As shown, round plastic holder 61 has the same diameter as the metal member 60. Round plastic holder 61 is formed with a diametrically extending groove (no numeral) in which a circular permanent magnet 62 is snugly and tightly received. As shown, the magnet 62 is received in the center part of the groove and the depth of the groove is greater than the thickness of magnet 62. Although not shown in the drawings, the magnet 62 has at its diametrically opposed portions flat edges that intimately abut against inner surfaces of the two walls that define therebetween the groove. With this, undesired radial leakage of magnetic force from the magnet 62 is suppressed or at least minimized. It is to be noted that the magnet 62 is positioned away from heads of bolts 58 by a sufficient distance.

As is best seen from FIG. 3, rotation angle sensor 44 further comprises a plastic circular casing 63 that is fixed to the housing 35. For this fixing, a stepped portion of circular casing 63 is snugly received in a circular opening 35*e* of housing 35. Circular casing 63 is formed at an inner side thereof with a cylindrical recess 63*a* that receives therein round plastic holder 61 keeping an annular clearance therebetween. A Hall-element 64 is embedded in circular casing 63 in a manner to surround the round plastic holder 61.

As is seen from FIG. 8, information signal produced by rotation angle sensor 44 is processed by control unit 40. By detecting the N-pole and S-pole from the magnet 62, the rotation angle sensor 44 senses a rotation angle (or angular position) of control shaft 32, that is fed to control unit 40.

Figure 14:
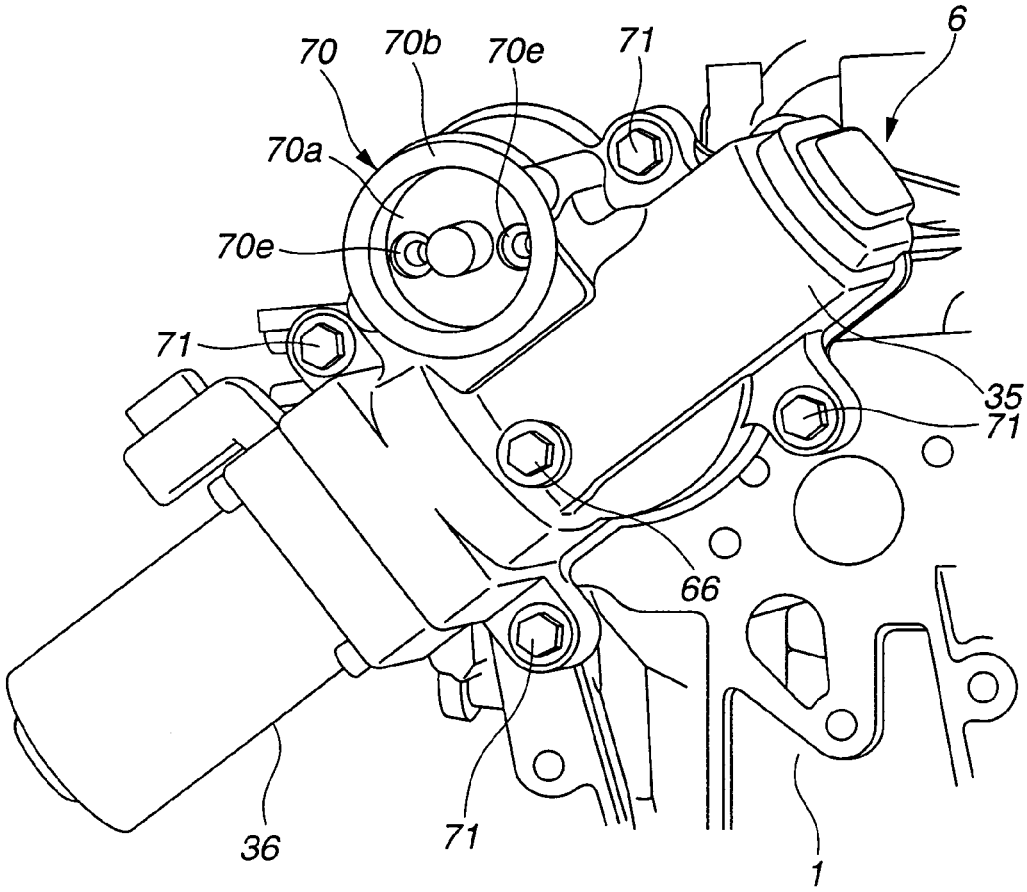
FIGS. 14 to 18 are views for explaining the steps for properly connecting a lever member of the actuating mechanism to the control shaft.
Figure 15:
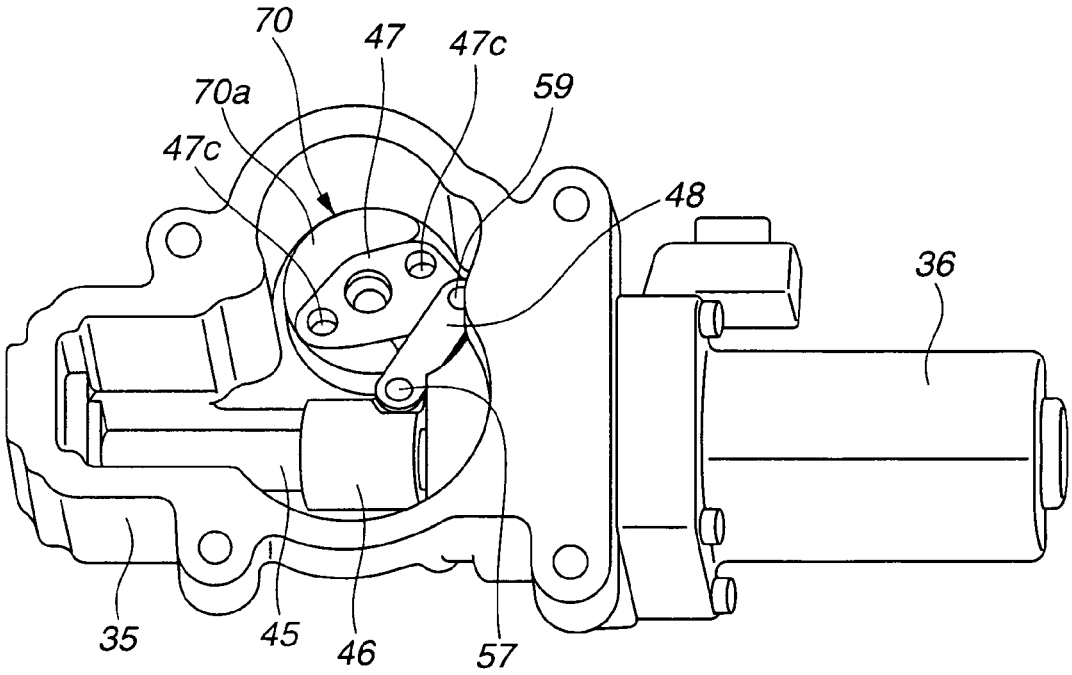

It is to be noted that, as is understood from FIGS. 3, 14 and 15, to opening 35*e* of housing 35, there is detachably fitted a guide cap 70 for keeping the connection between lever member 47 and link member 48 at the time when various parts of the actuating mechanism 6 are being assembled in housing 35.

Figure 12:
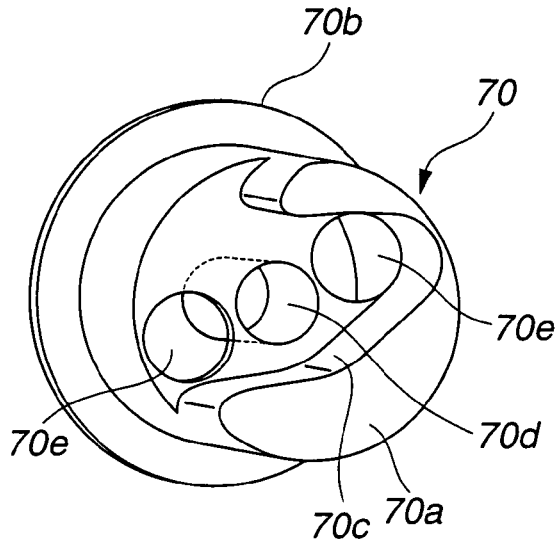
FIG. 12 is a front perspective view of a guide cap used in the present invention.
Figure 13:
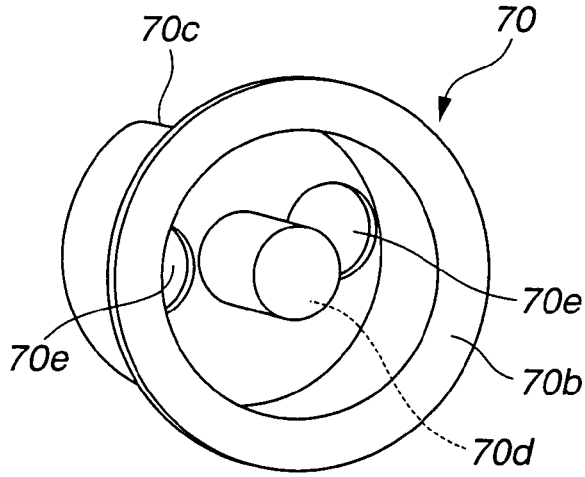
FIG. 13 is a back perspective view of the guide cap.

The detailed construction of guide cap 70 is shown in FIGS. 12 and 13. Guide cap 70 is made of a molded plastic and comprises a cylindrical cap proper 70*a* that is to be fitted in the opening 35*e* of housing 35, a flange portion 70*b* that is integrally formed on one axial end of the cap proper 70*a*, and a curved recess 70*c* provided at a bottom portion of cap proper 70*a*. For the purpose that will be described hereinafter, the curved recess 70*c* has such a shape as to correspond to a unit that includes lever member 47 and link member 48.

Furthermore, guide cap 70 has a cylindrical recess 70*d* into which the above-mentioned round plastic holder 61 is to be inserted. As shown, the cylindrical recess 70*d* is exposed to a generally middle portion of the curved recess 70*c*. Furthermore, guide cap 70 has at both sides of cylindrical recess 70*d* a pair of openings 70*e* into which the heads of the above-mentioned bolts 58 are to be roughly inserted. These openings 70*e* are larger than heads of bolts 58. As shown, these paired openings 70*e* are exposed to longitudinally opposed portions of the curved recess 70*d*.

In the following, steps for connecting lever member 47 to control shaft 32 and assembling rotation angle sensor 44 after assemblage of actuating mechanism 6 to cylinder head 1 will be described in detail with reference to FIGS. 6 and 14 to 18.

As is seen from FIG. 14, prior to connecting housing 35 of actuating mechanism 6 to cylinder head 1 by means of four connecting bolts 71, the above-mentioned positioning bolt 66 is deeply engaged with positioning opening 65 of housing 35 and ball-screw shaft 45 is turned in a direction about its axis to cause ball-nut 46 to take the leftmost position in FIG. 4 contacting with rod portion 66*a* of positioning bolt 66, as is understood from FIG. 6.

Then, guide cap 70 is fitted into opening 35*e* of housing 35 assuring a positioning therebetween. As is seen from FIG. 15 that shows a back view of housing 35, upon fitting of guide cap 70 into opening 35*e*, a given part of guide cap 70 pushes ball-nut 46 to turn about the shaft 45 in a direction to near electric motor 36, so that the curved recess 70*c* of guide cap 70 neatly receive both lever member 47 and link member 48 keeping the leftmost position of ball-nut 46 that is in contact with rod portion 66*a* of positioning bolt 66.

Thus, lever member 47 and link member 48 are suppressed from making a free movement as well as inclination toward this side in FIG. 15. Then, with this condition kept, base portion 47*a* of lever member 47 is brought into contact with flange 32*a* of control shaft 32 while inserting the annular projection 32*c* of control shaft 32 into annular recess 47*d* of base portion 47*a*, as will be understood from FIG. 3. With this, coaxial arrangement between control shaft 32 and lever member 47 is assured.

Figure 16:
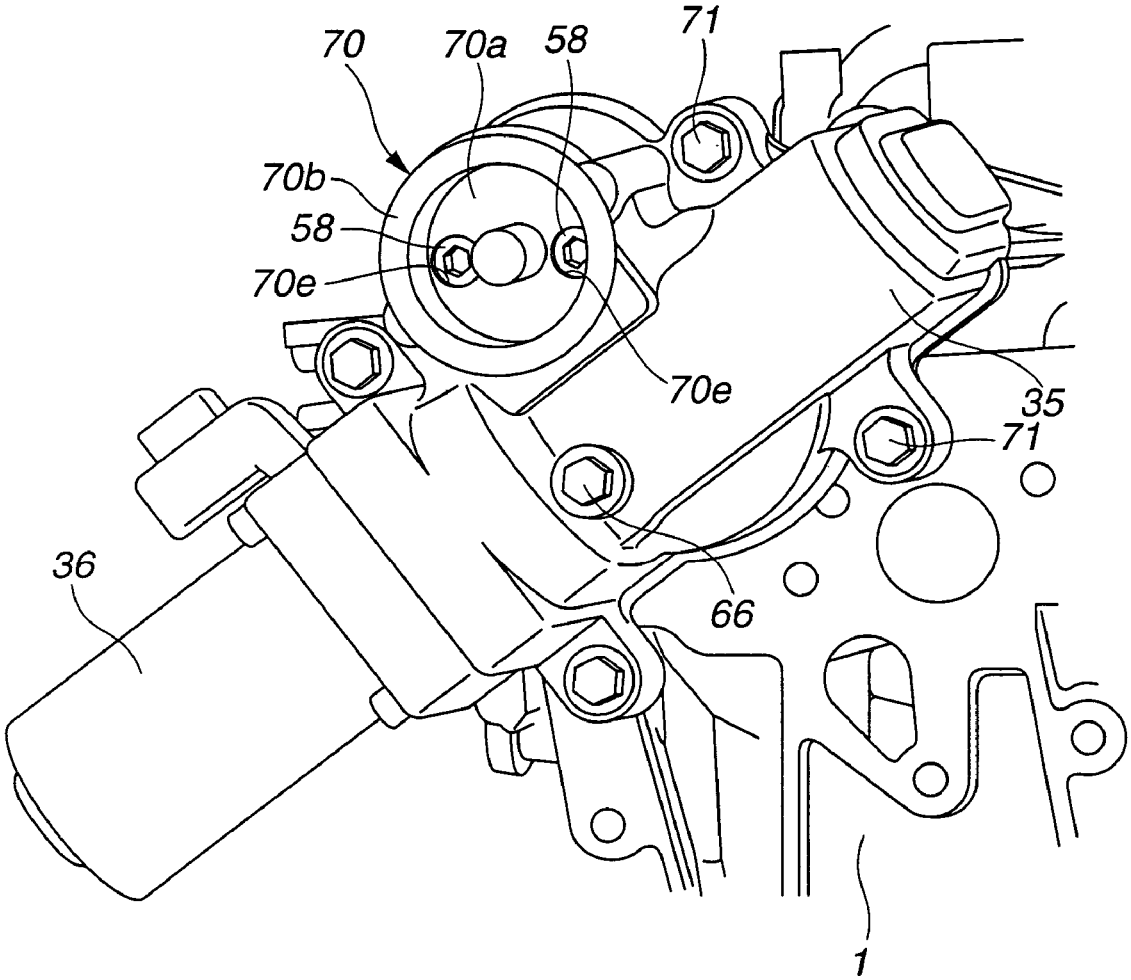

Then, as is seen from FIG. 16, after passing through openings 70*e* of guide cap 70 and arcuate openings 47*c* of lever member 47, the two bolts 58 are engaged with threaded bores 32*b* of flange 32*a* of control shaft 32. During this time, by using the arcuate shape of the openings 47*c*, base portion 47*a* of lever member 47 is somewhat turned relative to flange 32*a* of control shaft 32 to assure a proper positioning between lever member 47 and flange 32*a* of control shaft 32. Then, the two bolts 58 are strongly turned against threaded bores 32*b* of flange 32*a*. With this, lever member 47 is properly fixed to the flange 32*a* of control shaft 32, in such a manner as is shown in FIG. 3.

Figure 17:
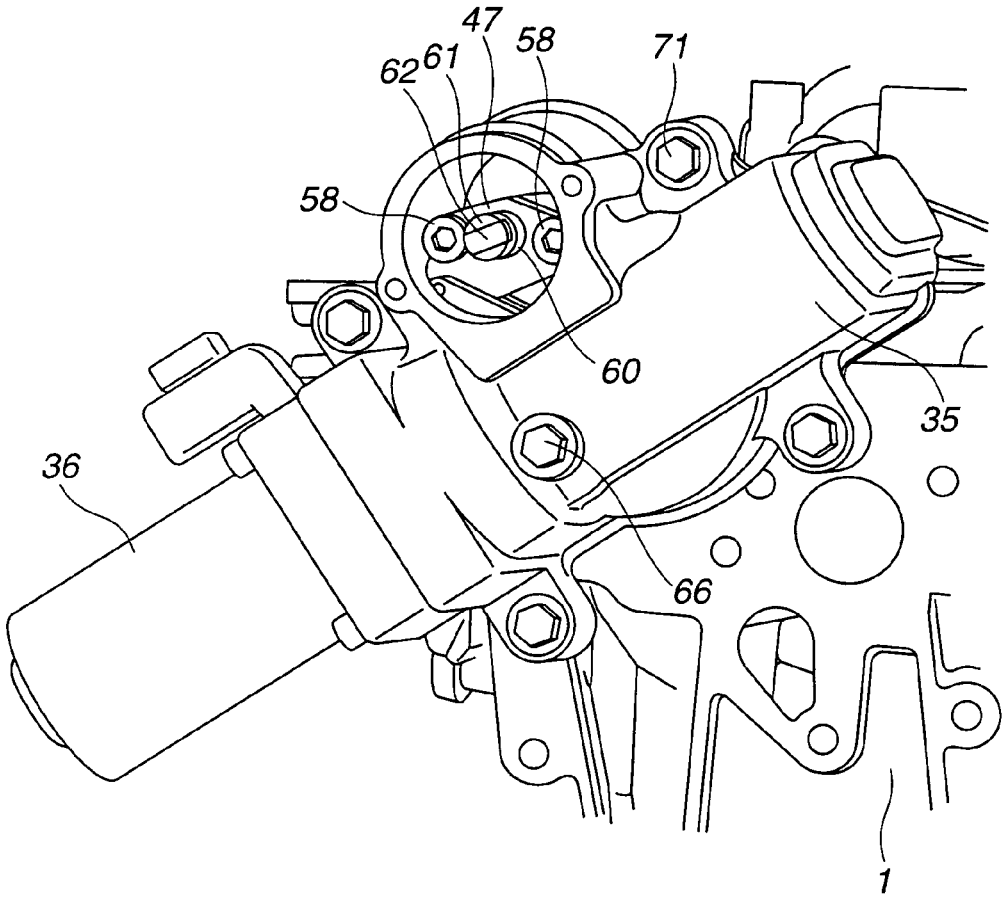

Then, as is seen from FIG. 17, guide cap 70 is detached from opening 35*e* of housing 35. Thus, under this condition, cylindrical metal member 60, round plastic holder 61, permanent magnet 62 and heads of the bolts 58 are exposed to the outside through the opening 35*e*, as is seen from this drawing.

Figure 18:
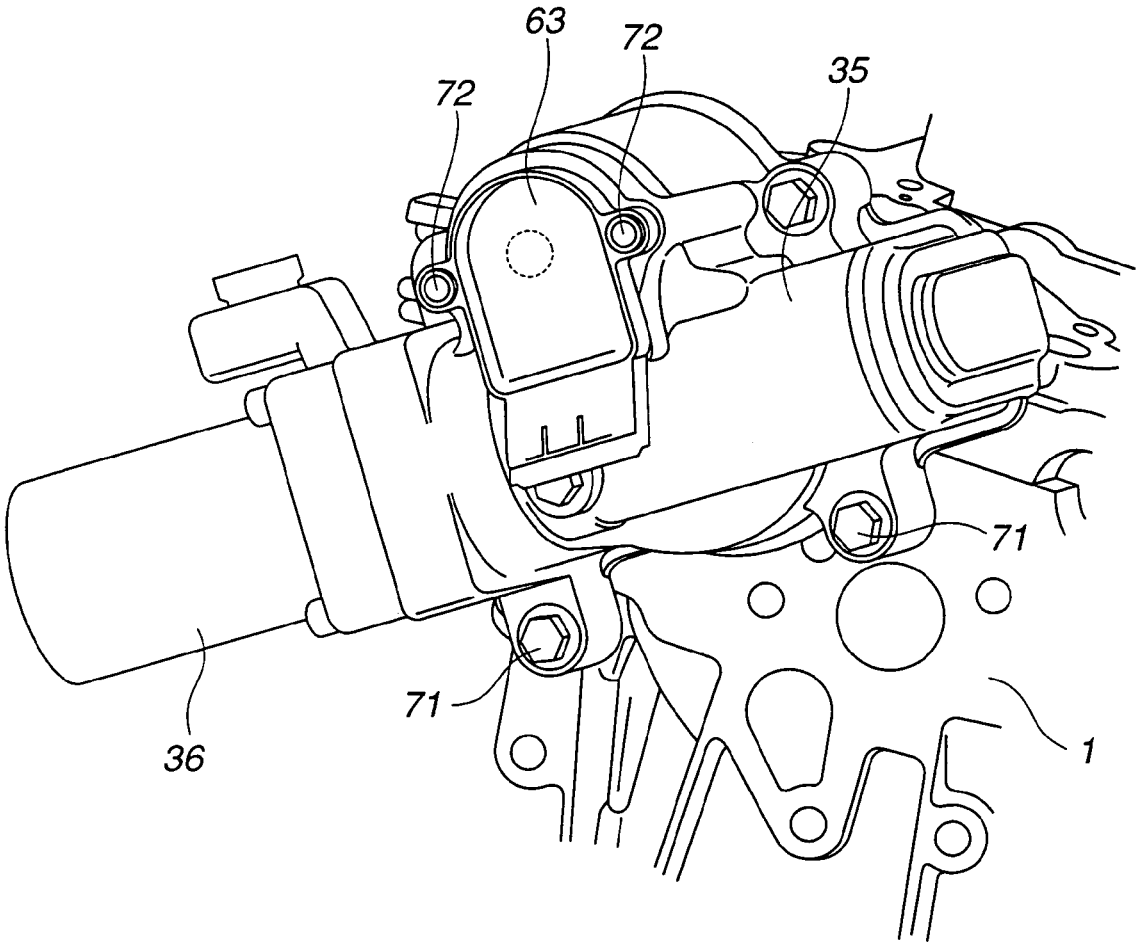

Then, as is seen from FIG. 18, plastic circular casing 63 is fitted to circular opening 35*e* of housing 35 and secured to the same by means of two bolts 72. Thereafter, positioning bolt 66 is removed from positioning opening 65, and as is seen from FIG. 7, close bolt 67 is fixed to positioning opening 65 to close the same. Then, a terminal (not shown) provided on circular casing 63 is connected to control unit 40 by a suitable harness.

In the following, operation of variable valve system 100 actuated by actuating mechanism 6 will be briefly described with reference to the drawings, particularly FIGS. 4, 5, 8, 9A, 9B, 10A and 10B.

For ease of understanding, the description on the operation will be commenced with respect to a condition wherein the associated engine starts to run at a lower speed, such as a speed at idling.

In such case, as is seen from FIG. 5, electric motor 36 is actuated in accordance with an instruction signal outputted from control unit 40. As is seen from FIG. 4, upon this, a torque produced by electric motor 36 is transmitted to ball-screw shaft 45 to rotate the same. With this, ball-nut 46 is moved axially leftward along ball-screw shaft 45 allowing fine balls 54 to run in and along a passage that is defined by and between spiral thread 53 of ball-nut 46 and spiral thread 49 of ball-screw shaft 45. That is, ball-nut 46 is moved toward electric motor 36 and finally to the leftmost position that has been determined by positioning bolt 66.

During the leftward movement of ball-nut 46 on ball-screw shaft 45, lever member 47 and thus control shaft 32 are turned clockwise in FIG. 4. (It is to be noted that the clockwise turning of control shaft 32 in FIG. 4 induces a counterclockwise turning of the same in FIGS. 9A to 10B).

Figure 9B:
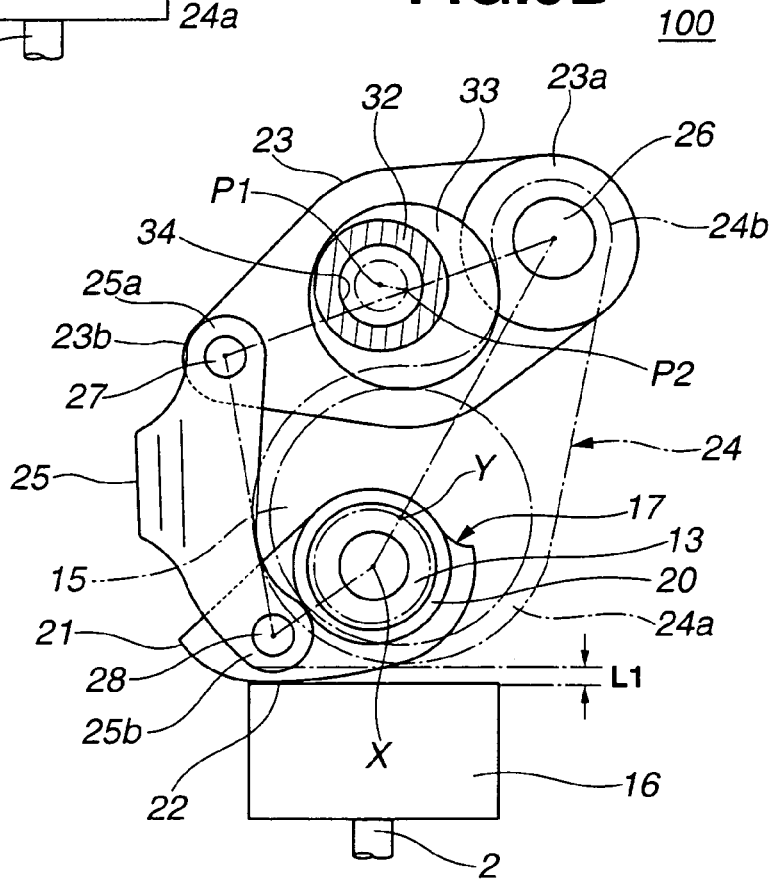

Upon this, as is seen from FIGS. 9A and 9B, control cam 33 secured to control shaft 32 is turned counterclockwise about the axis "P1" of control shaft 32 moving the thickest cam part thereof upward away from drive shaft 13, and finally control cam 33 takes the angular position as shown in these drawings. In other words, in this case, the entire construction of rocker arm 23 takes a relatively high position. Thus, under this condition, as is seen from FIG. 9A, the uppermost position that can be taken by pivot pin 27 provided between left wing part 23*b* of rocker arm 23 and upper end 25*a* of link rod 25 is a first position that is remote from drive shaft 13. This means that as is seen from FIGS. 9A and 9B, under operation of the variable valve system 100, link rod 25 and thus swing cam 17 are forced to operate at a position remote from valve lifter 16.

Figure 11:
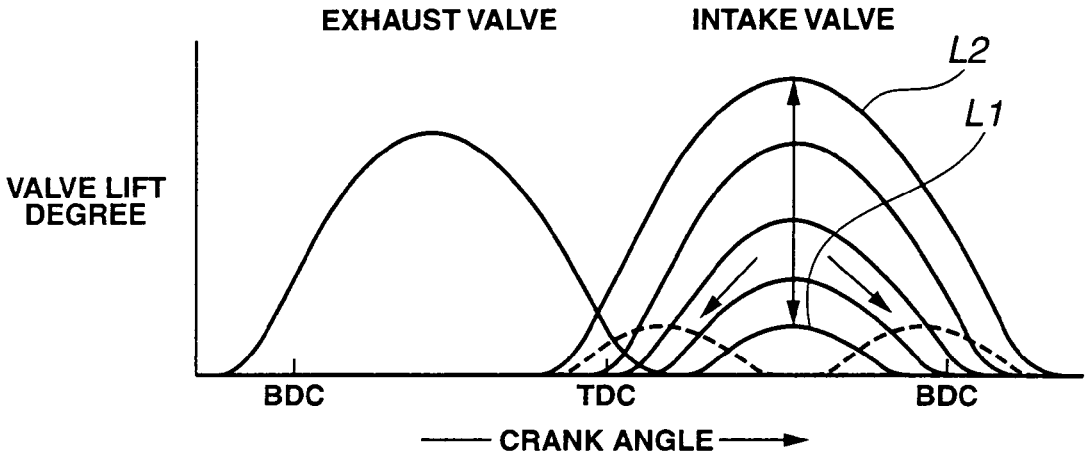
FIG. 11 is a graph showing a valve lift characteristic of each intake valve, which is provided by the variable valve system of the present invention.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position remote from valve lifter 16. That is, as is understood from FIG. 9B and the graph of FIG. 11, under this condition, the valve lift shows the smallest degree "L1" inducing a retarded open timing of intake valves 2 and 2 thereby minimizing the over wrap period with the associated exhaust valves. Thus, improved fuel consumption and stable running of the engine are obtained under such lower speed condition of the engine. In FIG. 11, reference "BDC" indicates a bottom dead center and reference "TDC" indicates a top dead center.

While, when the engine is subjected to a high speed operation, control unit 40 (see FIG. 8) controls electric motor 36 to run in a reversed direction. As is seen from FIG. 5, upon this, ball-nut 46 is moved rightward on and along ball-screw shaft 45. That is, ball-nut 46 is moved away from electric motor 36 allowing fine balls 54 to run in and along the passage defined by and between spiral thread 53 of ball-nut 46 and spiral thread 49 of ball-screw shaft 45.

Accordingly, as is seen from FIG. 5, lever member 47 and thus control shaft 32 are turned counterclockwise in the drawing. (It is to be noted that the counterclockwise turning of control shaft 32 in FIG. 5 induces a clockwise turning of the same in FIGS. 9A to 10B).

Figure 10A:
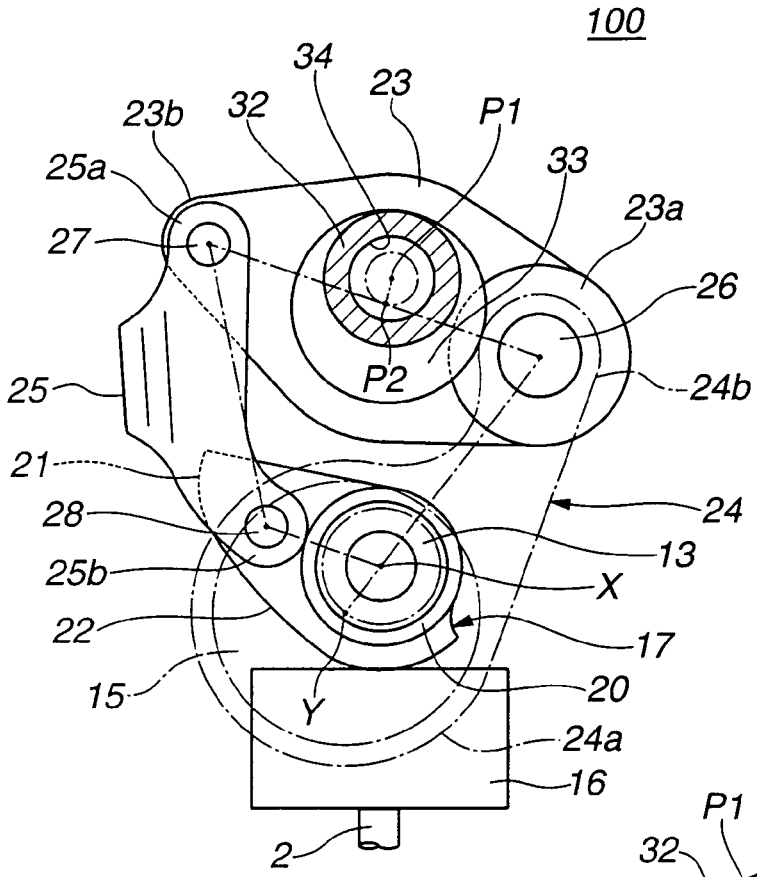
Figure 10B:
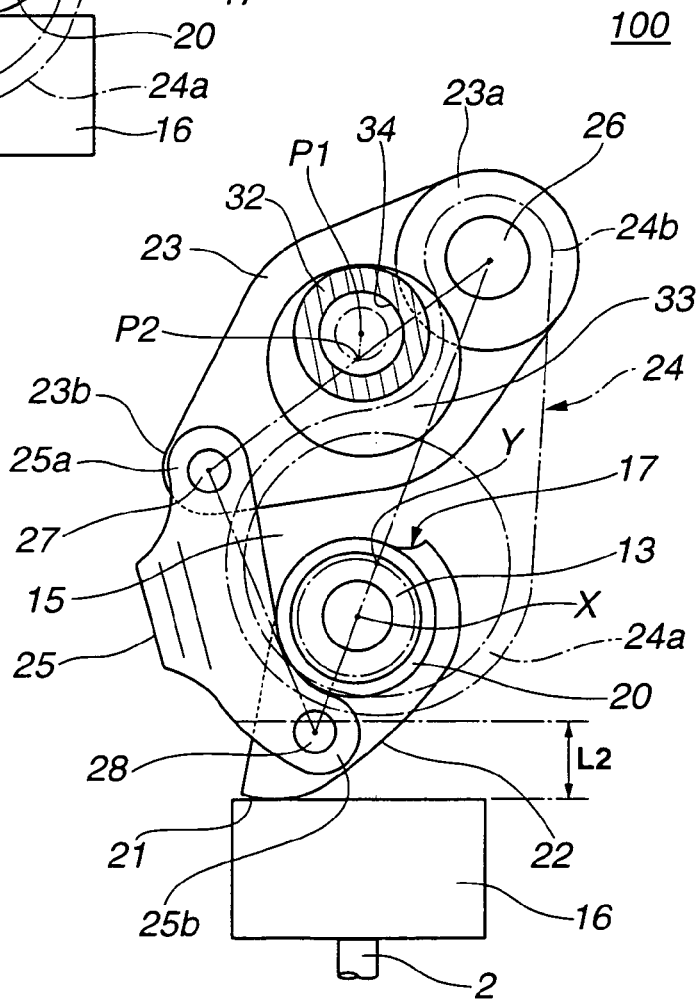

Upon this, as is seen from FIGS. 9A, 10A and 10B, control cam 33 is turned clockwise about the axis "P1" of control shaft 32 moving the thickest cam part thereof downward toward drive shaft 13, and finally control cam 33 takes the angular position as shown in FIGS. 10A and 10B. In other words, in this case, the entire construction of rocker arm 23 takes a relatively low position. Thus, under this condition, as is seen from FIG. 10A, the uppermost position that can be taken by pivot pin 27 is a second position that is near drive shaft 13 as compared with the above-mentioned first position. This means that as is seen from FIGS. 10A and 10B, under operation of variable valve system 100, link rod 25 and thus swing cam 17 are forced to operate at a position near valve lifter 16.

Accordingly, when, due to rotation of drive shaft 13, drive cam 15 is rotated in annular base portion 24*a* of link arm 24, rocker arm 23 is forced to swing reciprocating link rod 25 and swing cam 17 at such a position near valve lifter 16. That is, as is seen from FIG. 10B and the graph of FIG. 11, under this condition, the valve lift shows the largest degree "L2". As is seen from the graph of FIG. 11, the close timing of each intake valve 2 is retarded in accordance with an advancement of the open timing. That is, the work angle is increased. Thus, intake air charging efficiency is increased and thus sufficient engine power is obtained in such high speed condition.

As is described hereinabove, in accordance with the present invention, due to employment of the position matching device (65, 66) that includes threaded positioning opening 65 of housing 35 and positioning bolt 66 detachably connectable to the opening 65, the most-moved position (viz., the leftmost position in FIG. 4) of ball-nut 46 can be previously set, which matches with the most-tuned angular position of control shaft 32 determined by the stopper mechanism 29. Accordingly, even after positioning bolt 66 is removed from the opening 65, the most-moved position of ball-nut 46 is assuredly provided by the stopper mechanism 29. This means that as is understood from FIG. 4 under such most-moved positioning of ball-nut 46, there is left a certain clearance between ball bearing 50 and ball-nut 46 and thus the most-turned angular position of control shaft 32 is not affected by the operation range of ball-nut 46.

That is, as is seen from FIG. 1, under the most-turned angular position of control shaft 32 wherein stopper arm 29*c* contacts first stopper pin 29*a*, intake valves 2 are forced to show their smallest lift degree "L1" as is shown by FIGS. 9A and 9B. In this case, as is seen from FIG. 4, ball-nut 46 stays near ball bearing 50 without contacting the same. Thus, the angular operation range of control shaft 32 is not affected by the most-moved position of ball-nut 46, but affected by only the stopper mechanism 29.

Accordingly, control shaft 32 can have a higher positioning accuracy at the most-turned angular position, which brings about a higher valve lift controllability of intake valves 2.

As is mentioned hereinabove, due to practical usage of guide cap 70, lever member 47 and link member 48 can be stably held keeping the relative positioning therebetween at the time of assembling the actuating mechanism 6. Thus, the work for connecting the lever member 47 to control shaft 32 is readily and precisely carried out. Furthermore, the practical usage of guide cap 70 facilitates the convey of actuating mechanism 6 to a desired position, and facilitates the preparation for connecting the actuating mechanism 6 to an associated engine.

After connecting the lever member 47 to control shaft 32, guide cap 70 is removed from opening 35*e* of housing 35 and plastic circular casing 63 is fitted to opening 35*e* to close the same. Casing 63 thus has a function to close opening 34*e* as well as a function to hold Hall-element 64, which means reduction in number of parts used and thus reduction in cost.

Furthermore, due to usage of guide cap 70, the work for turning bolts 58 to fix lever member 47 to flange 32*a* of control shaft 32 is readily made. Actually, openings 70*e* of guide cap 70 that accommodate heads of bolts 58 serve as a guide means for bolts 58. Presence of openings 70*e* facilitates the work for detaching guide cap 70 from opening 35*e* of housing 35.

Due to usage of close bolt 67 fitted to positioning opening 65, the interior of housing 35 is protected from dust and the like.

Due to usage of coil spring 68 that biases ball-nut 46 in an axial direction, backlash of ball-nut 46 is suppressed or at least minimized. Furthermore, due to presence of such coil spring 68, direct contact of ball-nut 46 against the other ball bearing 51 is avoided.

For example, the arrangement of electric motor 32 may change in accordance with the layout of engine room. Furthermore, in place of electric motor 32, a hydraulic motor or the like may be used.

For connecting round plastic holder 61 to the leading end of cylindrical metal member 60 (see FIG. 1), a threaded coupling or the like may be used. The diameter of the holder 61 may change in accordance with size of permanent magnet 62. The holder 61 may be made of a hard rubber, aluminum or the like as long as it exhibits a non-magnetic characteristic.

In place of ball-screw shaft 45 and ball-nut 46 that employ a plurality of fine balls 54, a normal bolt-nut arrangement may be used.

Although the foregoing description is directed to the system for controlling intake valves 2 of the engine, the present invention is applicable to exhaust valves and both intake and exhaust valves.

The entire contents of Japanese Patent Application 2004-177783 filed Jun. 16, 2004 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A variable valve system of an internal combustion engine for varying an operation manner of an engine valve by controlling an angular position of a control shaft, comprising:

a stopper mechanism that determines an angular range in which the control shaft is permitted to rotate about its axis;

an actuating mechanism that actuates the control shaft to rotate about its axis; and a position matching device separate from the stopper mechanism that is practically assembled only when the actuating mechanism is being assembled, the position matching device when assembled restricting operation of the actuating mechanism in such a manner as to match a maximally operated position of the actuating mechanism with a maximally operated angular position of the control shaft.

2. A variable valve system as claimed in claim 1, in which the actuating mechanism comprises:

an externally threaded shaft that is turned about its axis in accordance with the operation condition of the engine;

an internally threaded nut member operatively engaged with the threaded shaft so that turning of the threaded shaft induces an axial movement of the nut member along the threaded shaft, the nut member being contactable with the position matching device when the latter is assembled;

a lever member connected to the control shaft to rotate therewith;

a link member that pivotally connects the lever member and the nut member; and a guide member that is detachably connected to a housing of the actuating mechanism, the guide member, when connected to the housing, holding both the lever member and the link member keeping a given clearance between the nut member and a stopper means in the housing, the guide member being removed from the housing once the connection between the lever member and the link member is properly achieved.

3. A variable valve system as claimed in claim 2, further comprising:

a first member connected to the lever member to rotate therewith; and a second member connected to the housing and arranged to surround the first member, wherein the first member and second member constitute a rotation angle sensor that detects the angular portion of the control shaft.

4. A variable valve system as claimed in claim 3, in which an end of the control shaft is formed with a flange portion that is formed with threaded openings, in which the lever member is formed with bolt openings through which connecting bolts pass before being engaged with the threaded openings of the flange portion thereby to secure the lever member to the flange portion and in which the guide member is formed with openings that have a size larger than heads of the connecting bolts.

5. A variable valve system as claimed in claim 2, in which the guide member is formed with a curved recess that is shaped to snugly receive therein a unit that includes the lever member and the link member.

6. A variable valve system as claimed in claim 2, in which the lever member is formed with bolt openings through which bolts pass before being engaged with threaded openings formed in a flange portion formed on an end of the control shaft, the lever member and the flange portion having at their mutually facing portions male-female constructions that are mated when the lever member and the flange portion are secured to each other, and in which the bolts openings of the lever member are elongate openings that extend around the axis of the control shaft.

7. A variable valve system as claimed in claim 1, in which the actuating mechanism comprises:

an externally threaded shaft that is turned about its axis in accordance with the operation condition of the engine;

an internally threaded nut member operatively engaged with the threaded shaft so that turning of the threaded shaft induces an axial movement of the nut member along the threaded shaft, the nut member being contactable with the position matching device when the latter is assembled;

a lever member connected to the control shaft to rotate therewith;

a link member that pivotally connects the lever member and the nut member; and a housing that houses therein the threaded shaft, the threaded nut member, the lever member and the link member, and in which the position matching device comprises a positioning opening formed in the housing at a position where the nut member arrives when the same is maximally moved along the threaded shaft, the positioning opening being adapted to hold a positioning bolt that is projected into the housing to stop an excessive movement of the nut member.

8. A variable valve system as claimed in claim 7, further comprising a close bolt that is connected to the positioning opening in place of the positioning bolt once assemblage of the actuating mechanism is substantially finished.

9. A variable valve system as claimed in claim 1, further comprising:

a drive shaft synchronously rotated about its axis by a crankshaft of the engine, the drive shaft having a drive cam connected thereto;

a swing cam rotatably supported by the drive shaft, the swing cam having a cam surface that is contactable with a valve lifter of the engine valve to induce an open/close movement of the engine valve; and a rocker arm having one end operatively connected to the drive cam through a link arm and the other end operatively connected to the swing cam through a link rod, wherein when, upon energization of the actuating mechanism, the control shaft is rotated about its axis to assume a new angular position, a swing fulcrum of the rocker arm is changed and thus a position where the cam surface of the swing cam contacts the valve lifter is changed thereby varying the lift degree of the engine valve.

10. A variable valve system as claimed in claim 7, in which the positioning opening is internally threaded and in which an externally threaded portion of the positioning bolt is engaged with the threaded positioning opening.

11. A variable valve system as claimed in claim 7, in which the positioning opening is internally threaded and in which an externally threaded portion of a close bolt is engaged with the threaded positioning opening once the assemblage of the actuating mechanism is substantially finished.

12. A variable valve system as claimed in claim 7, in which the positioning bolt is temporally connected to the positioning opening.

13. A variable valve system as claimed in claim 7, further comprising a biasing member that is provided between the nut member and the housing to bias the nut member in a given axial direction of the threaded shaft.

14. A variable valve system of an internal combustion engine for varying an operation manner of an engine valve by controlling an angular position of a control shaft, comprising:

a stopper mechanism that determines an angular range in which the control shaft is permitted to rotate about its axis; and an actuating mechanism that actuates the control shaft to rotate about its axis, the actuating mechanism comprising:

an externally threaded shaft that is turned about its axis in accordance with the operation condition of the engine;

an internally threaded nut member operatively engaged with the threaded shaft so that turning of the threaded shaft induces an axial movement of the nut member along the threaded shaft, the nut member being contactable with the position matching device when the latter is assembled;

a transmission mechanism provided between the control shaft and the nut member to convert the axial movement of the nut member to a rotary motion of the control shaft;

a housing that houses therein the threaded shaft, the threaded nut member and the transmission mechanism; and a position matching device that is practically assembled only when the actuating mechanism is being assembled, the position matching device when assembled restricting operation of the actuating mechanism in such a manner as to match a maximally operated position of the actuating mechanism with a maximally operated angular position of the control shaft.

15. A variable valve system as claimed in claim 14, in which the transmission mechanism comprises a lever member connected to the control shaft to rotate therewith; and a link member that pivotally connects the lever member and the nut member, and further comprises a guide member that is detachably connected to the housing of the actuating mechanism, the guide member, when connected to the housing, holding both the lever member and the link member keeping a given clearance between the nut member and a stopper means provided in the housing, the guide member being removed from the housing once the connection between the lever member and the link member is properly achieved.

16. A variable valve system as claimed in claim 15, further comprising:

a drive shaft synchronously rotated about its axis by a crankshaft of the engine, the drive shaft having a drive cam connected thereto;

a swing cam rotatably supported by the drive shaft, the swing cam having a cam surface that is contactable with a valve lifter of the engine valve to induce an open/close movement of the engine valve; and a rocker arm having one end operatively connected to the drive cam through a link arm and the other end operatively connected to the swing cam through a link rod, wherein when, upon energization of the actuating mechanism, the control shaft is rotated about its axis to assume a new angular position, a swing fulcrum of the rocker arm is changed and thus a position where the cam surface of the swing cam contacts the valve lifter is changed thereby varying the lift degree of the engine valve.

17. A variable valve system as claimed in claim 14, in which the position matching device comprises:

a positioning opening formed in the housing at a position where the nut member arrives when the same is maximally moved along the threaded shaft; and a positioning bolt that is engageable with the positioning opening to be projected into the housing to stop an excessive movement of the nut member.

18. A variable valve system as claimed in claim 17, further comprises a close bolt that is connected to the positioning opening in place of the positioning bolt once assemblage of the actuating mechanism is substantially finished.

* * * * *